US011276925B2

(12) United States Patent
Ramasamy

(10) Patent No.: US 11,276,925 B2
(45) Date of Patent: Mar. 15, 2022

(54) SYSTEM AND METHOD FOR ESTABLISHING AND OPERATING PLURAL ANTENNA SYSTEMS IN PROXIMITY

(71) Applicant: Dell Products, LP, Round Rock, TX (US)

(72) Inventor: Suresh K. Ramasamy, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 15/884,644

(22) Filed: Jan. 31, 2018

(65) Prior Publication Data

US 2019/0237865 A1 Aug. 1, 2019

(51) Int. Cl.

| | |
|---|---|
| ***H01Q 1/52*** | (2006.01) |
| ***H01Q 5/35*** | (2015.01) |
| ***H01Q 1/22*** | (2006.01) |
| ***H01Q 21/00*** | (2006.01) |
| ***H01Q 1/02*** | (2006.01) |

(52) U.S. Cl.

CPC ..... *H01Q 1/523* (2013.01); *H01Q 1/02* (2013.01); *H01Q 1/2266* (2013.01); *H01Q 5/35* (2015.01); *H01Q 21/0025* (2013.01)

(58) Field of Classification Search

CPC H01Q 1/523; H01Q 5/35; H01Q 1/02; H01Q 1/2266; H01Q 21/0025

See application file for complete search history.

(56) References Cited

U.S. PATENT DOCUMENTS

| | | | | |
|---|---|---|---|---|
| 5,760,749 | A | 6/1998 | Minowa | |
| 6,353,540 | B1 | 3/2002 | Akiba | |
| 7,187,559 | B2 | 3/2007 | Hirabayashi | |
| 9,887,165 | B2 | 2/2018 | Pagani | |
| 2001/0040529 | A1* | 11/2001 | Cheng | H01Q 1/241 343/702 |
| 2002/0036897 | A1* | 3/2002 | Nakajima | G06F 1/1616 361/752 |
| 2002/0075186 | A1 | 6/2002 | Hamada | |
| 2002/0135525 | A1* | 9/2002 | Ikegaya | H01Q 9/0421 343/767 |
| 2003/0092396 | A1* | 5/2003 | Fifield | H05K 1/0237 455/80 |

(Continued)

FOREIGN PATENT DOCUMENTS

CN 106935964 A 7/2017

*Primary Examiner* — Dimary S Lopez Cruz
*Assistant Examiner* — Bamidele A Jegede
(74) *Attorney, Agent, or Firm* — Prol Intellectual Property Law, PLLC; H. Kenneth Prol

(57) ABSTRACT

An information handling system comprising a processor, a memory, and a wireless adapter with a first and second antenna feed operatively connected to the wireless adapter for communicating on a plurality of wireless links and disposed on a circuit board having a trench through one or more metallic layers with a perimeter edge dimension extending from an outer edge of the circuit board into the circuit board where the first antenna feed mounted adjacent to a first side of the trench of the circuit board and operatively connected to a first antenna and the second antenna feed mounted adjacent to a second side of the trench of the circuit board opposite to the first side and the second antenna feed operatively connected to a second antenna.

20 Claims, 9 Drawing Sheets

(56) References Cited

U.S. PATENT DOCUMENTS

2003/0193437 A1* 10/2003 Kangasvieri ..... H01Q 1/243 343/702
2004/0217905 A1* 11/2004 Konishi ..... G06F 1/1616 343/702
2006/0279465 A1* 12/2006 Moon ..... H01Q 1/38 343/700 MS
2007/0001911 A1* 1/2007 Fujio ..... H01Q 9/0407 343/700 MS
2008/0278384 A1* 11/2008 Shimasaki ..... H01Q 13/10 343/702
2011/0068995 A1* 3/2011 Baliarda ..... H01Q 9/0421 343/848
2013/0207853 A1* 8/2013 Yamamoto ..... H01Q 1/002 343/702
2013/0241800 A1* 9/2013 Schlub ..... H01Q 21/29 343/893
2013/0342425 A1* 12/2013 Wong ..... H01Q 21/30 343/893
2014/0111926 A1* 4/2014 Reid ..... G06F 1/203 361/679.09
2014/0139380 A1* 5/2014 Ouyang ..... H01Q 7/00 343/702
2014/0162572 A1* 6/2014 Hirabayashi ..... H01Q 21/28 455/73
2015/0002367 A1* 1/2015 Kosaka ..... H01Q 9/42 343/893
2016/0172311 A1* 6/2016 Pagani ..... H01L 23/562 324/762.01
2016/0226139 A1* 8/2016 Yu ..... H01Q 9/42
2016/0242236 A1* 8/2016 Saban ..... H04W 88/085
2017/0117608 A1* 4/2017 Bologna ..... G06F 1/1681
2017/0117611 A1* 4/2017 Lepe ..... H01Q 1/2266
2017/0194689 A1* 7/2017 Takasu ..... H01Q 1/2258
2017/0317710 A1* 11/2017 Liu ..... H04B 1/0057
2018/0122752 A1 5/2018 Pagani

* cited by examiner

SYSTEM AND METHOD FOR ESTABLISHING AND OPERATING PLURAL ANTENNA SYSTEMS IN PROXIMITY

FIELD OF THE DISCLOSURE

The present disclosure generally relates to a method and apparatus for a mechanism for creating a plurality of radio antenna systems within close proximity to one another to be used with information handling systems having limited size.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, and networking systems. Information handling systems can also implement various virtualized architectures. Data communications among information handling systems may be via networks that are wired, wireless, optical or some combination. For wireless communications, one or more wireless interface adapters may be used including antenna systems, a front end antenna module and other radio frequency subsystems. Users may choose from among several available radiofrequency communication platforms in information handling systems for data and other communications with other users via communication and data networks. Accordingly, plural antenna systems may be used with an information handling system. With some systems, such as plural antennas operating within similar protocols or frequency bands, interference between plural antenna systems may be an issue.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

DETAILED DESCRIPTION OF THE DRAWINGS

Figure 1:
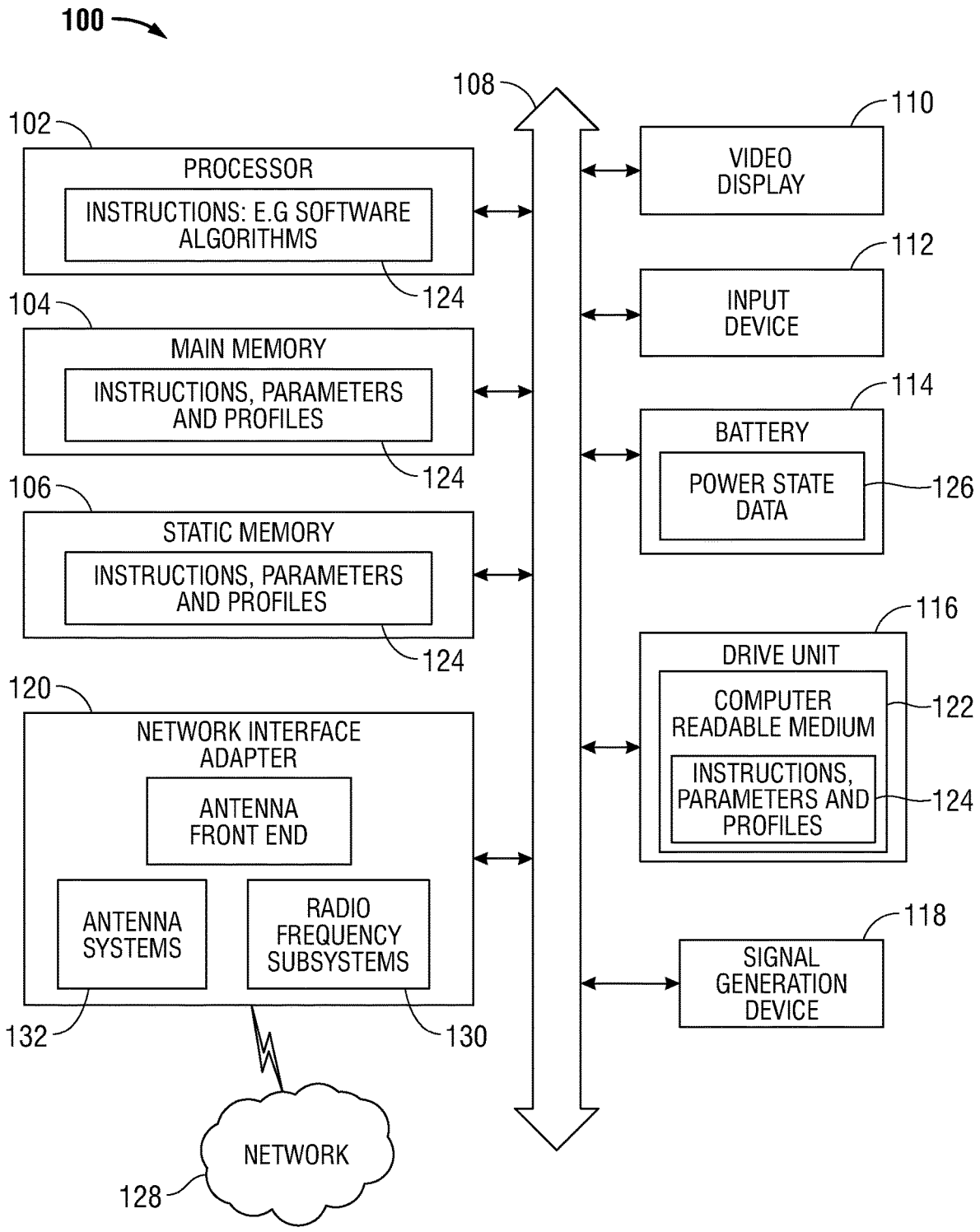
FIG. 1 is a block diagram illustrating an information handling system according to an embodiment of the present disclosure.

The following description in combination with the Figures is provided to assist in understanding the teachings disclosed herein. Aspects within the Figures are not necessarily drawn to scale and may be estimations of position and size for purposes of explanation of various embodiments herein. The description is focused on specific implementations and embodiments of the teachings, and is provided to assist in describing the teachings. This focus should not be interpreted as a limitation on the scope or applicability of the teachings.

In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality. The information handling system may be of a variety of models and types. For example, a personal computer may be a laptop, a 360 convertible computing device, a tablet, smart phone, wearable computing device, a dual housing convertible tablet computing device, or other mobile information handling system and may have several configurations and orientation modes. The information handling system can include memory (volatile (e.g. random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. In an aspect, the information handling system may have a plurality of antenna systems for communication via wireless links operating on a variety of radio access technologies (RAT). In another aspect, several antenna systems may be available for each RAT to enable aggregated data communications such as via plural multiple in, multiple out (MIMO) streams to enhance bandwidth or reliability. Antenna systems may be operated via one or more wireless adapters that may include controllers, memory and other subsystems some of which may operate as a radio frequency (RF) front end for one or more antenna systems to transmit wirelessly. Portions of an information handling system may themselves be considered information handling systems.

In some types of convertible information handling systems, a plurality of housings may be connected by a hinge structure enabling reconfiguration of the convertible information handling systems into a plurality of usage mode configurations. For example, a convertible laptop system may have a housing for a display and a housing for a keyboard which may be rotated around a hinge structure to provide for a laptop usage mode configuration and a tablet usage mode configuration in an embodiment. Further, other configurations may be available for the convertible laptop information handling system including options on the laptop usage mode, a tent mode, or other table usage mode configurations. In other embodiments, the convertible information handling system may include two housings which may support a single, bendable display screen or a plurality of display screens. The housings again may be operatively connected via a hinge such that the housings may rotate around the hinge with respect to one another for various usage mode configurations of the display screen or display screens including a laptop configuration, dual tablet, single tablet, tent mode, easel mode, book mode, as well as other usage mode configurations. In many instances, it is aesthetically desirable for the convertible information handling system to have housings with a metal cover, sometimes referred to as an A-cover, having no break in the metal cover for antenna systems as may be required for some antenna systems mounted in the A-cover. Further, thin metal housings are desirable in some circumstances as well.

Due to thinness and efficient size as well as aesthetic considerations, area to locate a plurality of wireless antenna systems may be limited. Accordingly, it may be desirable to mount antenna systems nearby to one another. In embodiments two or more antenna systems may be used. In some example embodiments, 2×2 antenna systems, 4×4 antenna systems or any array of antenna systems may be deployed on a mobile information handling system such as a convertible information handling system. These plural antenna systems may, in some embodiments, operate at frequency bandwidths that overlap or may be nearby bandwidth ranges or result in interference from harmonics as well as antenna proximity. As antennas are located further from one another physically, the risk of port to port coupling or other causes of interference or reduction in signal quality are reduced. Further, as operating bandwidths are further apart, interference causes may also be reduced. However, with limited area for location of antenna systems in thin and efficient information handling systems, accommodation of proximate antenna systems may be desirable in various embodiments of the present disclosure. Further, a system and structure for reducing potential sources of signal quality reduction or interference provides for further accommodation of antenna systems operating more closely to one another in mobile information handling system according to embodiments herein.

Antennas upon location may be fixed such that radiation pattern or mode and specific absorption rate (SAR) hotspots are fixed with respect to the location of the antenna. In such an instance, the antenna radiation pattern is limited in adaptations to its radiation pattern and the radiation patterns of proximate antenna systems may have directionality to overlap potentially causing interference when proximate antenna system operate in similar frequency bands. An isolation trench adaptation between proximate antennas may adjust the radiofrequency transmission radiation pattern to provide an effective feature for minimizing power losses arising from port coupling or other causes. Several example embodiments are described herein.

FIG. 1 shows an information handling system 100 capable of administering each of the specific embodiments of the present disclosure. The information handling system 100 can represent the mobile information handling systems or servers or systems located anywhere within wireless network, including the remote data centers operating virtual machine applications. Information handling system 100 may represent a mobile information handling system associated with a user or recipient of intended wireless communication. A mobile information handling system may execute instructions via a processor for an antenna optimization system including concurrent wireless link utilization according to embodiments disclosed herein. The application programs communicating or otherwise operating via concurrently wireless links may operate in some example embodiments as software, in whole or in part, on a mobile information handling system while other portions of the software applications may operate on remote server systems. The antenna optimization system of the presently disclosed embodiments may operate as firmware, software, or hardwired circuitry or any combination on controllers or processors within the information handing system 100 or some of its components such as a wireless interface adapter 120. Information handling system 100 may also represent a networked server or other system and administer aspects of the antenna optimization system via instructions executed on a processor according to various embodiments herein involving remote operation of such systems. The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, a solid state display, or a cathode ray tube (CRT). In some embodiments, a plurality of video display units 110 may be utilized. Display 110 may include a touch screen display module and touch screen controller (not shown) for receiving user inputs to the information handling system 100. Touch screen display module may detect touch or proximity to a display screen by detecting capacitance changes in the display screen as understood by those of skill. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a 360 degree convertible device such as a convertible laptop or convertible double tablet, a wearable computing device, or a mobile smart phone.

The information handling system 100 can include a set of instructions 124 that can be executed to cause the computer system to perform any one or more of the methods or computer based functions disclosed herein. For example, instructions 124 may software applications which utilize one or more wireless links for wireless communications via the wireless interface adapter as well as other aspects or components. Similarly instructions 124 may be executed as antenna optimization system disclosed herein for monitoring wireless links and adjusting wireless antenna systems and resources although in some aspects the antenna optimization system may operate as firmware on a controller within the wireless interface device 120. Instructions 124 may also include aspects of the antenna optimization system as part of an antenna front end 125 described in the present disclosure and operating as firmware or software to remedy or adjust one or more of a plurality of antenna systems 132 via selecting wireless link communication frequency band channels, adjusting power levels to cutback to meet SAR regulatory requirements, or other adjustments. Adjustments may be made for multiple antenna systems operating on various communication frequency bands to avoid interference due to nearness of transmission or reception due to nearness of frequency channels or due to physical proximity of the antenna systems among other factors in some aspects. In other aspects instructions 124 may execute algorithms to regulate operation of the one or more antenna systems 132 in the information handling system 100 to avoid poor wireless link performance due to potential effects of interference from nearby antenna operation, both physically and in frequency of wireless link channels used as well as due to impedance mismatching or other factors.

Various software modules comprising software application instructions 124 or firmware instructions may be coordinated by an operating system (OS) and via an application programming interface (API). An example operating system may include Windows®, Android®, and other OS types known in the art. Example APIs may include Win 32, Core Java API, or Android APIs. In a further example, processor 102 may conduct monitoring and processing of mobile information handling system usage trends by the information handling system 100 according to the systems and methods disclosed herein. The computer system 100 may operate as a standalone device or may be connected such as using a network, to other computer systems or peripheral devices.

In a networked deployment, the information handling system 100 may operate in the capacity of a server or as a client user computer in a server-client user network environment, or as a peer computer system in a peer-to-peer (or distributed) network environment. The information handling system 100 can also be implemented as or incorporated into various devices, such as a personal computer (PC), a tablet PC, a set-top box (STB), a PDA, a mobile information handling system, a tablet computer, a laptop computer, a desktop computer, a communications device, a wireless smart phone, wearable computing devices, a land-line telephone, a control system, a camera, a scanner, a facsimile machine, a printer, a pager, a personal trusted device, a web appliance, a network router, switch or bridge, or any other machine capable of executing a set of instructions (sequential or otherwise) that specify actions to be taken by that machine. In a particular embodiment, the computer system 100 can be implemented using electronic devices that provide voice, video or data communication. Further, while a single information handling system 100 is illustrated, the term "system" shall also be taken to include any collection of systems or sub-systems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Further, the instructions 124 may embody one or more of the methods or logic as described herein. For example, instructions relating to the antenna optimization system algorithms or antenna adjustment policies described in embodiments herein may be stored here or transmitted to local memory located with the antenna front end 125 in the wireless interface adapter 132.

In a particular embodiment, the instructions, parameters, and profiles 124 may reside completely, or at least partially, within the main memory 104, the static memory 106, and/or within the disk drive 116 during execution by the processor 102 of information handling system 100. As explained, some or all of the applications program instructions 124 may be executed locally or remotely. The main memory 104 and the processor 102 also may include computer-readable media. Battery 114 may include a smart battery system that tracks and provides power state data 126. This power state data may be stored with the instructions, parameters, and profiles 124 to be used with the systems and methods disclosed herein.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more radio frequency subsystems 130 with transmitter/receiver circuitry, modem circuitry, one or more unified radio frequency front end circuits, one or more wireless controller circuits, amplifiers, antenna systems 132 and other radio frequency subsystem circuitry 130 for wireless communications via multiple radio access technologies. Each radiofrequency subsystem 130 may communicate with one or more wireless technology protocols. The radiofrequency subsystem 130 may contain individual subscriber identity module (SIM) profiles for each technology service provider and their available protocols for subscriber based radio access technologies such as cellular LTE communications. The wireless adapter 120 may also include antenna systems 132 which may be tunable antenna systems for use with the system and methods disclosed herein. Additional antenna system modification circuitry (not shown) may also be included with the wireless interface adapter 120 to implement coexistence control measures as described in various embodiments of the present disclosure.

In some aspects of the present disclosure, one wireless adapter 120 may operate two or more wireless links. In a further aspect, the wireless adapter 120 may operate the two or more wireless links with a single, shared communication frequency band such as with the 5G standard relating to unlicensed wireless spectrum for small cell 5G operation or for unlicensed Wi-Fi WLAN operation in an example aspect. For example, a 5 GHz wireless communication frequency band may be apportioned under the 5G standards for communication on either small cell WWAN wireless link operation or Wi-Fi WLAN operation. In some embodiments, the shared, wireless communication band may be transmitted through one or a plurality of antennas. Any number of antenna systems 132 may be utilized and a variety of wireless protocols used according to various embodiments herein. Other shared communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands. The plurality of wireless adapters 120 may further share a wireless communication band or operate in nearby wireless communication bands in some disclosed embodiments. Further, harmonics and other effects may impact wireless link operation when a plurality of wireless links are operating concurrently as in some of the presently described embodiments requiring antenna transmission adjustments. Additionally, SAR regulatory requirements may adjust or require adjustments to operation of antenna systems 132 and power cutback adjustments may be made via one or more of the plurality of wireless adapters 120.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. Wireless adapter 120 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers which may operate in both license and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). It is understood that any number of available channels may be available under the 5 GHz shared communication frequency band. WLAN, for example, may also operate at a 2.4 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. Some of these lower frequency bands may have greater wavelengths as discussed with respect to embodiments herein. In the example embodiment, mobile information handling system 100 includes both unlicensed wireless radio frequency communication capabilities as well as licensed wireless radio frequency communication capabilities. For example, licensed wireless radio frequency communication capabilities may be available via a subscriber carrier wireless service. With the licensed wireless radio frequency communication capability, WWAN RF front end may operate on a licensed WWAN wireless radio with authorization for subscriber access to a wireless service provider on a carrier licensed frequency band.

The wireless adapter 120 can represent an add-in card, wireless network interface module that is integrated with a main board of the information handling system or integrated with another wireless network interface capability, or any combination thereof. In an embodiment the wireless adapter 120 may include one or more radio frequency subsystems 130 including transmitters and wireless controllers for connecting via a multitude of wireless links. In an example embodiment, an information handling system may have an antenna system transmitter 132 for 5G small cell WWAN, Wi-Fi WLAN or WiGig connectivity and one or more additional antenna system transmitters 132 for macro-cellular communication. The radio frequency subsystems 130 include wireless controllers to manage authentication, connectivity, communications, power levels for transmission, buffering, error correction, baseband processing, and other functions of the wireless adapter 120.

The radio frequency subsystems 130 of the wireless adapters may also measure various metrics relating to wireless communication pursuant to operation of the antenna systems 132 as in the present disclosure. For example, the wireless controller of a radio frequency subsystem 130 may manage detecting and measuring received signal strength levels, bit error rates, signal to noise ratios, latencies, jitter, and other metrics relating to signal quality and strength. In one embodiment, a wireless controller of a wireless interface adapter 120 may manage one or more radio frequency subsystems 130. The wireless controller also manages transmission power levels which directly affect radio frequency subsystem power consumption as well as transmission power levels from the plurality of antenna systems 132. The transmission power levels from the antenna systems 132 may be relevant to specific absorption rate (SAR) safety limitations for transmitting mobile information handling systems. To control and measure power consumption via a radio frequency subsystem 130, the radio frequency subsystem 130 may control and measure current and voltage power that is directed to operate one or more antenna systems 132.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionality as described herein.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2B:
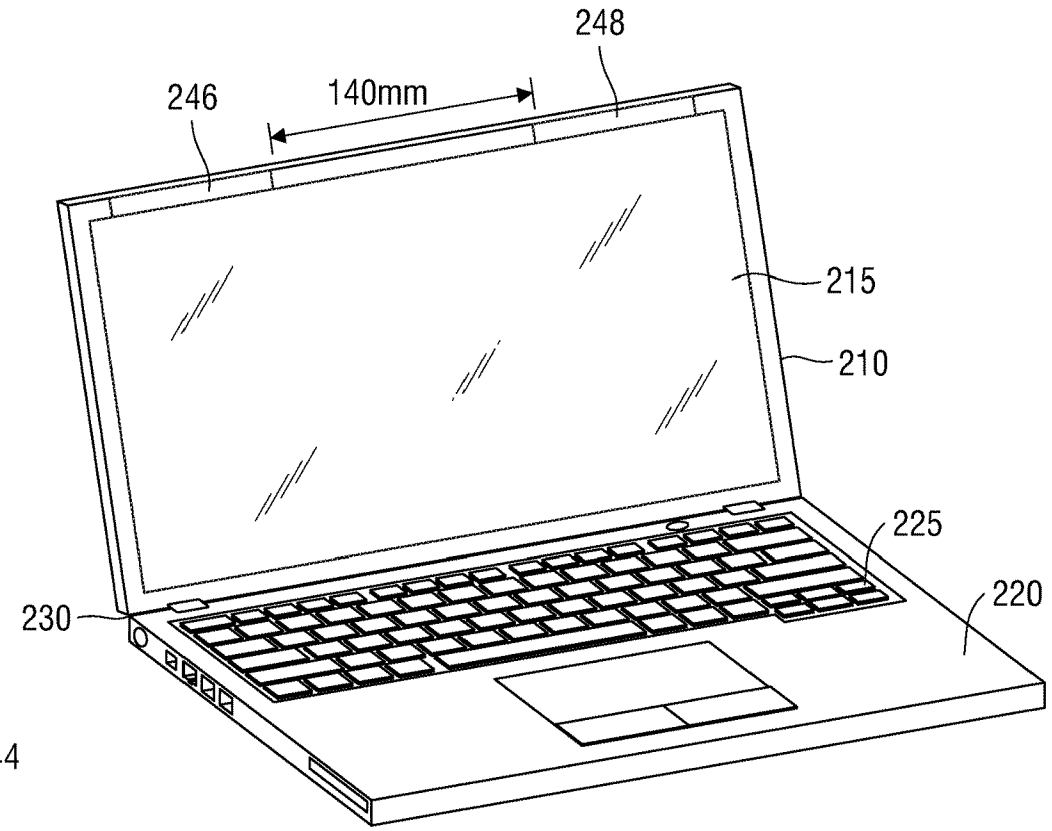
FIG. 2B is a graphical diagram of a mobile information handling system showing another plural antenna configuration with spacing.
Figure 2A:
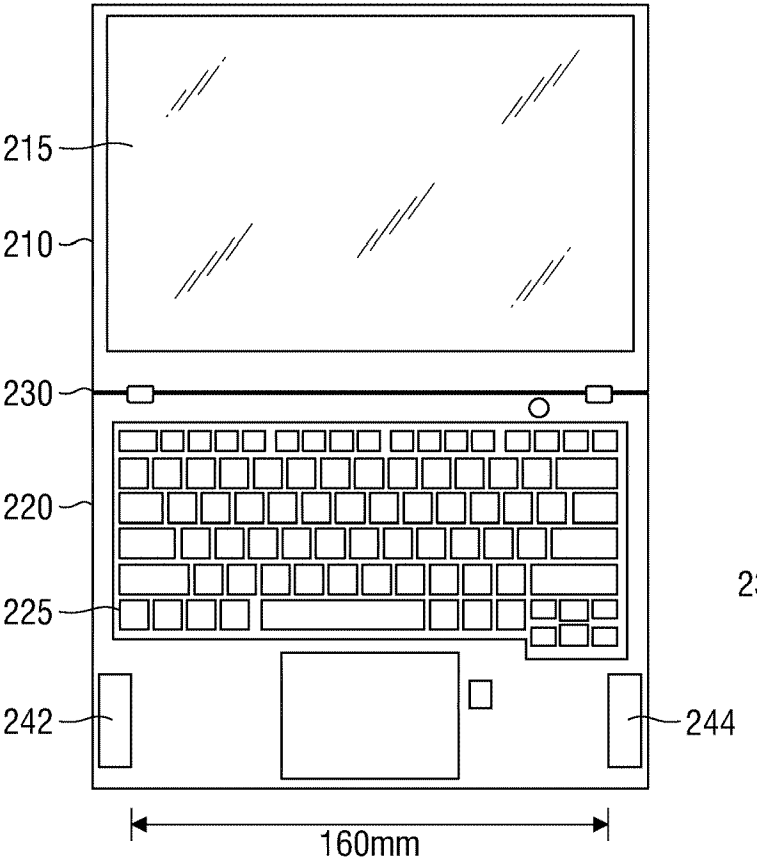
FIG. 2A is a graphical diagram of a mobile information handling system showing a plural antenna configuration with spacing.

FIG. 2A illustrates a convertible information handling system including a first display housing 210 and a second housing 220 operatively connected via hinge 230 in an example embodiment. In one example aspect, first display housing 210 includes display screen 215. In another example aspect, the second housing 220 is shown as a base housing for a convertible information handling system including a keyboard 225 such as for a laptop system. In other embodiments, second housing 220 may be a dual display housing system where one foldable display screen is mounted over the first display housing 210 and the second housing 220 or where each housing 210 and 220 has a separate display screen.

In current information handling system shown in FIG. 2A, antennas 242 and 244 are mounted in the second housing 220. In some embodiments, antennas 242 and 244 may be mounted as shown while in other embodiments antennas 242 and 244 may be located in the second housing 220 at any location including along the hinge or on separate edges of second housing 220. In the presently shown embodiment, the antennas 242 and 244 are mounted at least 160 mm apart. In some example embodiments, if antennas 242 and 244 are to operate within a same or similar frequency band, they must be separated by a substantial distance related to the lowest base frequency, or longest wavelength, in the band utilized. Further, previous plural antenna systems such as those operating at LTE frequency bands operated at higher frequencies such that shorter wavelengths were relevant to separation of antenna systems. With release of many lower band LTE systems as well as lower band WWAN systems with longer wavelengths, a requirement of distance separation based on wavelengths becomes more problematic. In some aspects, previous designs would separate antenna systems operating at a similar frequency band by at least one or two wavelengths.

FIG. 2B shows another example embodiment of a convertible information handling system with a first display housing 210 and a second housing 220 having a display screen 215 and a keyboard respectively and rotatable around hinge 230 between a plurality of usage mode configurations. In current information handling system, antennas 246 and 248 are mounted in the first display housing 210 along a top edge of the display screen 215. In some embodiments, antennas 246 and 248 may be mounted as shown while in other embodiments antennas 246 and 248 may be located anywhere on the first display housing 210 at any location including along the hinge or on separate edges of first display housing 210. In some embodiments, it may be that the antennas 246 and 248 are mounted on separate housings 210 and 220. In the presently shown embodiment, the antennas 246 and 248 are mounted at least 140 mm apart. As described, previous plural antenna systems may also have operated at higher frequencies such that shorter wavelengths were relevant to separation of antenna systems. With release of many lower band LTE systems as well as lower band WWAN systems with longer wavelengths, the distance separation requirement based on wavelengths to avoid interference becomes more problematic. As with the example of FIG. 2A, if antennas 246 and 248 of FIG. 2B are to operate within a same or similar frequency band, they must be separated by some distance relative to wavelengths of the lowest base frequency in the band utilized. In some aspects, previous designs would separate antenna systems operating at a similar frequency band by at least one or two wavelengths to minimize impact of interference such as that due to port coupling.

Figure 3:
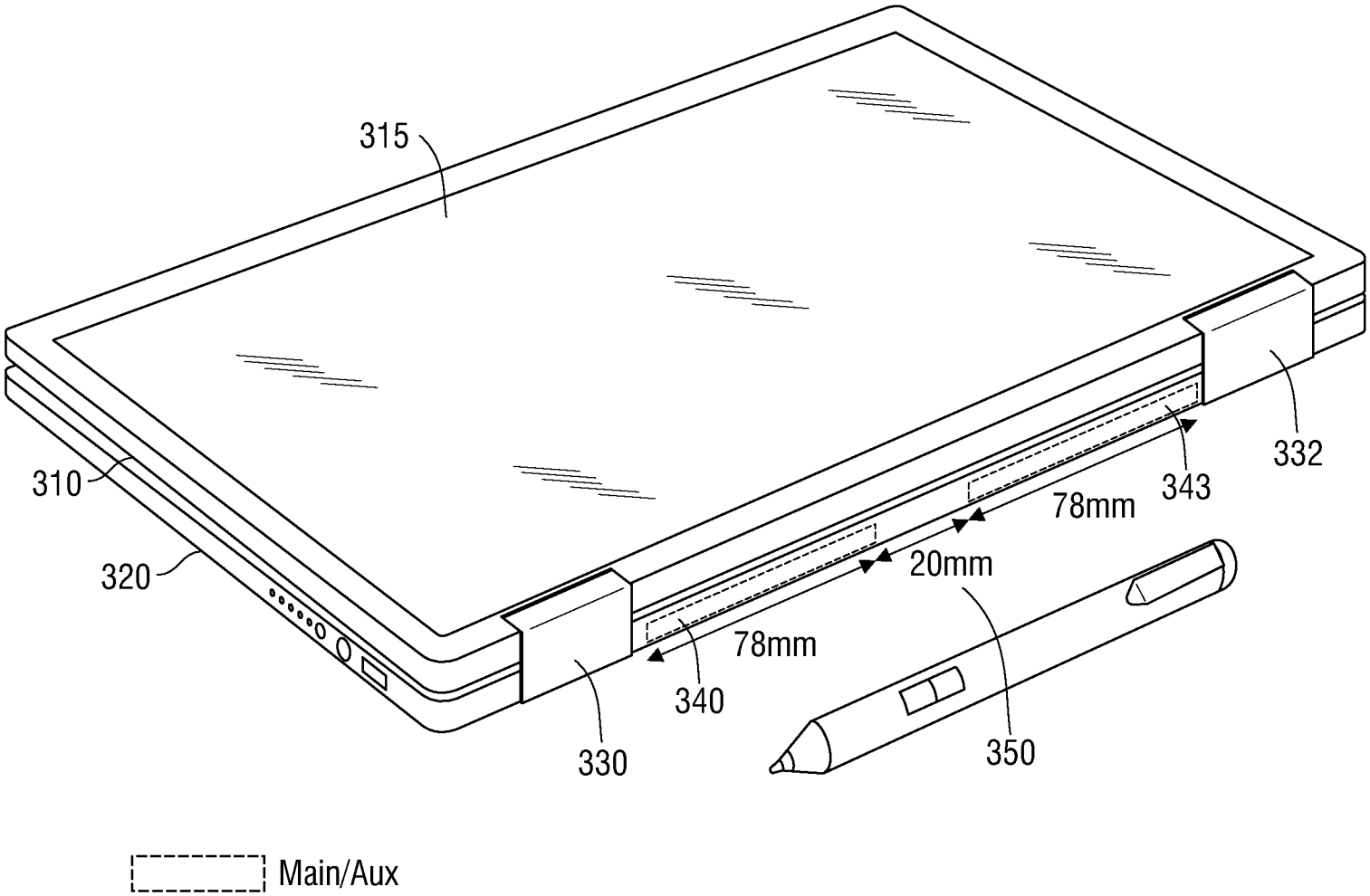
FIG. 3 is a graphical diagram of a mobile information handling system showing a plural antenna configuration with proximate spacing according to an embodiment of the present disclosure.

With the limited area available for thin, convertible information handling systems, with the use of lower frequencies with longer wavelengths, and with an increasing desire to pack more and more antennas for a variety of wireless protocols on the convertible information handling systems, the required spacings of antennas such as shown in FIG. 2A and FIG. 2B limits antenna placement options. A system and mechanism to provide for increased options of allowable spacings of antenna systems that may operate within the same or similar frequency bands is desirable when the area for antenna mountings are limited. The convertible information handling systems may operate, for example, with 2×2 or 4×4 multiple input, multiple output operation to increase available data bandwidths in some applications. In some cases, two or more antennas may be utilized with similar or same frequency bands with MIMO or other operation where bandwidth overlap is possible FIG. 3 illustrates a convertible information handling system including a first display housing 310 and a second housing 320 operatively connected via hinges 330 and 332 where two antennas 340 and 343 may be mounted along an edge of the second housing 320 according to an embodiment of the present disclosure. In the shown embodiment, main and auxiliary antennas 340 and 343 are spaced, as shown at 350, much more closely than the example designs previously permitted. In the example embodiment, antennas 340 and 343 are only separated by 20 mm. With embodiments of the present disclosure, a separation of less than 1/10 of the largest wavelength of the operating frequency bands is available between antennas 340 and 343 mounted within proximity of one another. The first display housing 310 is shown as housing a display screen 315. Second housing 320 may house keyboard as such for a convertible laptop information handling system in some embodiments. In other embodiments, second housing 320 may house a second display screen, or may have a bendable display screen mounted across first display housing 310 and second housing 320 in yet other embodiments. In some embodiments, antennas 340 and 343 may include a main LTE antenna and an auxiliary LTE antenna. In other embodiments, antennas 340 and 343 may include WLAN, WWAN antennas or some combination of these or other protocols operating on proximate antennas 340 and 343. It is contemplated that in yet other embodiments, more than two antennas other than antennas 340 and 343 as shown may also be mounted proximate to each other pursuant to embodiments disclosed herein.

Figure 4:
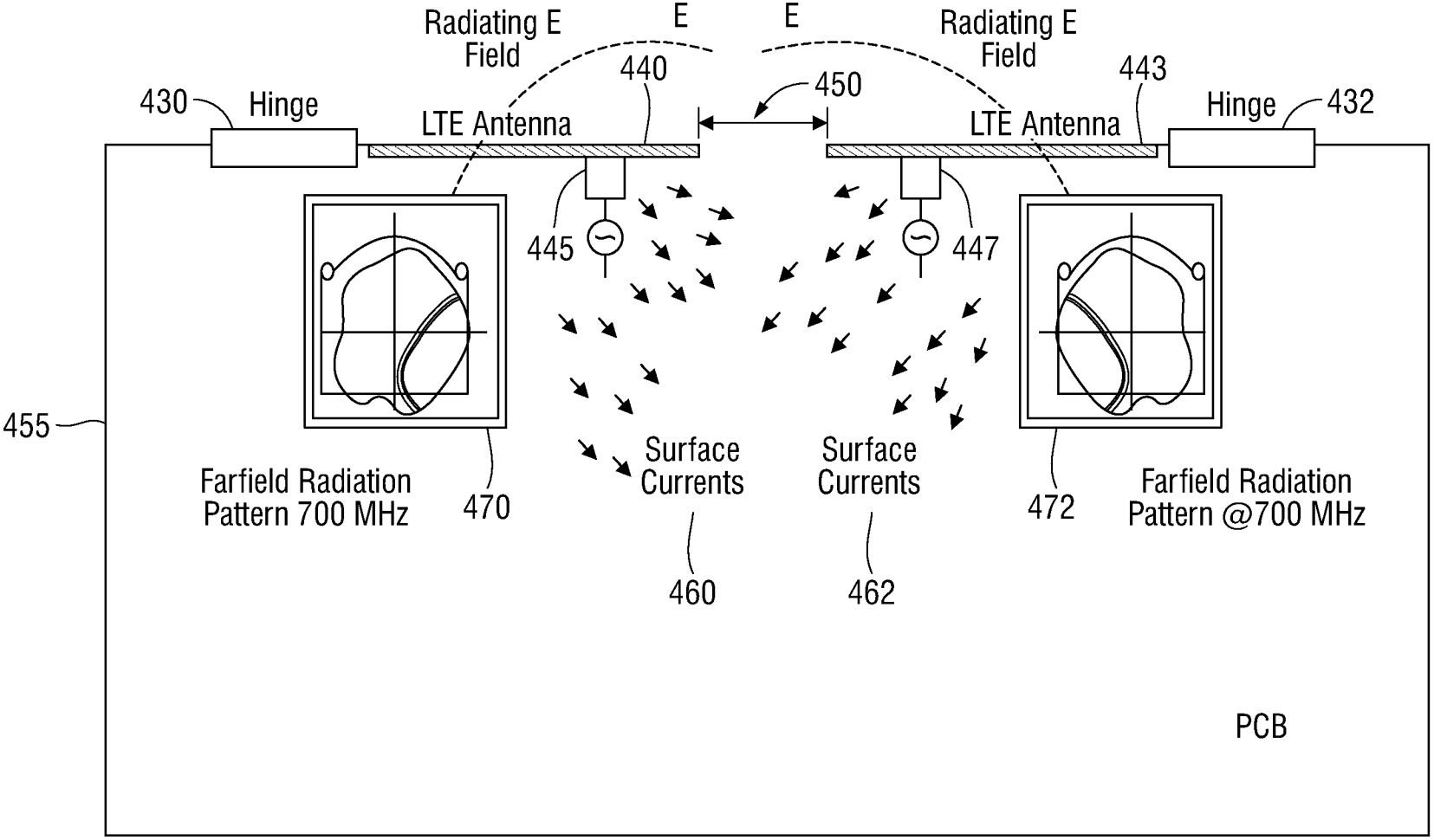
FIG. 4 is a graphical diagram of proximate antenna systems on a circuit board for a mobile information handling system according to an embodiment of the present disclosure.

FIG. 4 shows graphical diagram of proximate antenna systems mounted on a circuit board for a mobile information handling system with proximity distance 450 for antennas 440 and 443 are disposed which may be less than one or two wavelengths, for example at 1/10 wavelength in some example embodiments, for the lowest operating frequency of antenna feeds 445 and 447 in an example embodiment according to an embodiment of the present disclosure. In an example embodiment, proximate antennas 440 and 443 may be mounted less than 1/5 of one wavelength of the lowest operating frequency active on those antennas or even less than 1/10 of a wavelength of the lowest frequency operating on antenna feeds 445 and 447. FIG. 4 may represent a baseline of activity for a first antenna feed 445 operating a first antenna 440 and a second antenna feed 447 operating a second antenna 443 at the proximate distance 450 without an isolation trench as described in embodiments herein. As shown in this example embodiment, antennas 440 and 443 are disposed between hinge locations 430 and 432 on a PCB circuit board 455.

At the proximate distance 450, without isolation measures deployed between the antenna feeds 445 and 447, the proximity of antennas 440 and 443 may yield one or more causes of noise. For example, the far field radiation patterns 470 and 472 may have hotspots directed toward the respective opposite antenna and antenna feed. In other words, far field radiation pattern 470 of antenna 440 from antenna feed 445 may have a hotspot directed toward the proximate antenna 443 and its antenna feed 447 that potentially results in interference when both antennas 440 and 443 are operating in similar frequency bands. Additionally, surface currents 460 and 462 emanating from antenna feeds 445 and 447 on circuit board 455 may be directed toward the opposite proximate antenna feed across the circuit board from which they are generated. Such surface currents 460 and 462 directed toward an opposite, proximate antenna feed may induce undesirable coupling between antenna feeds 445 and 447 at those antenna ports. Similar types of interference may also yield interference in other embodiments with other antenna arrangements on a circuit board.

Figure 5:
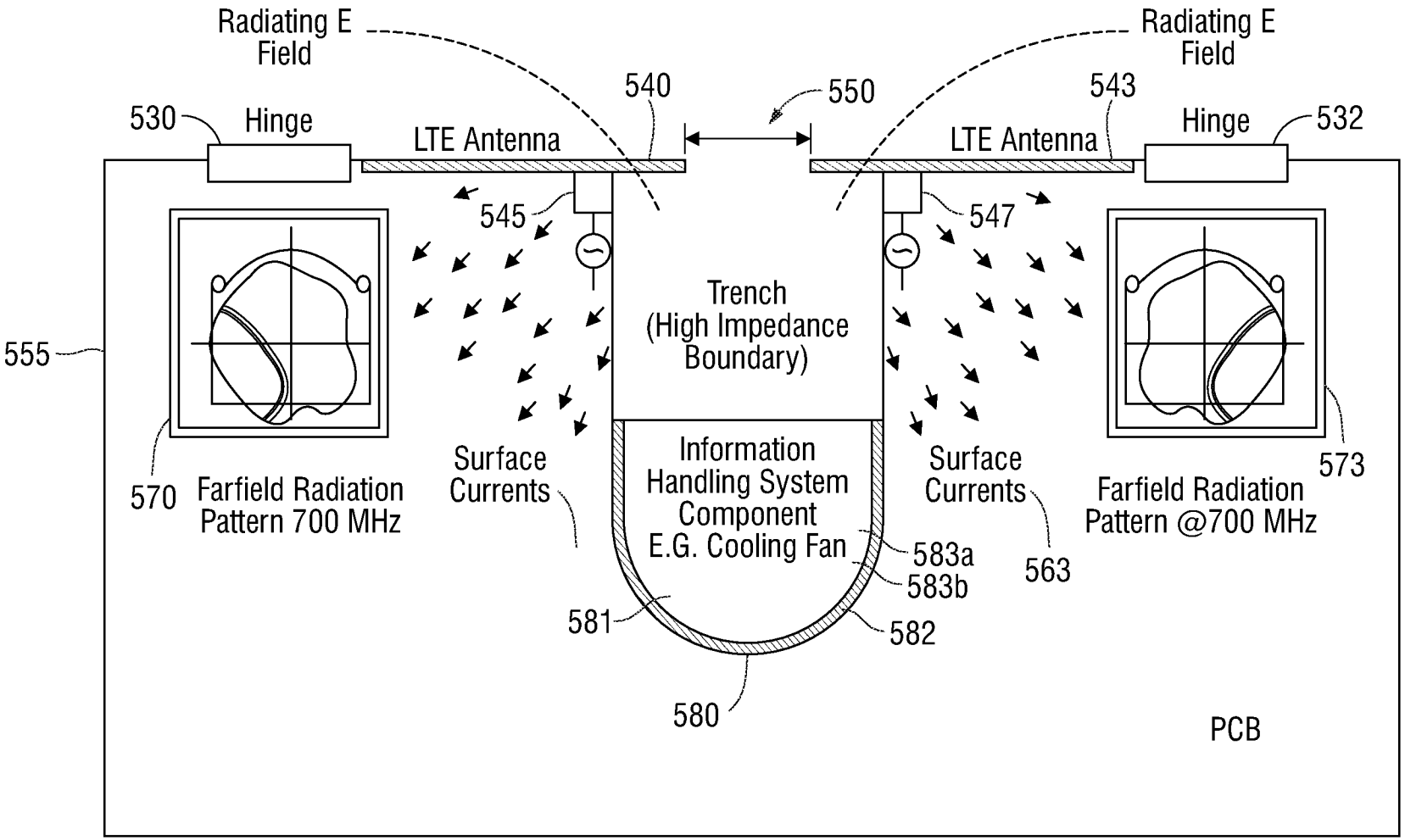
FIG. 5 is a graphical diagram of proximate antenna systems on a circuit board with a high impedance boundary for a mobile information handling system according to an embodiment of the present disclosure.

FIG. 5 shows graphical diagram of proximate antenna systems 540 and 543 mounted on a circuit board 555 for a mobile information handling system according to an embodiment of the present disclosure. Antenna systems 540 and 543 may be mounted on a circuit board 555 with proximity 550 that is less than one or two wavelengths according to embodiments herein. The antennas 540 and 543 are disposed at a proximate distance 550 which may be less than two wavelengths for the lowest operating frequency of antenna feeds 545 and 547 in an example embodiment. In some embodiments, the proximate distance 550 may be less than 1/5 of a wavelength or even less than 1/10 of a wavelength of the lowest frequency operating on antenna feeds 545 and 547. In one example embodiment, for the example frequency of 700 MHz, a distance 550 between antennas 540 and 543 may be less than 40 mm. However, the proximate distance 550 is across the isolation trench 580 between the antenna feeds 545 and 547. The previous issues of the proximity yielding one or more causes of noise may be improved with the implementation of the isolation trench 580 in the circuit board 555 according to embodiments herein. FIG. 5 may represent activity for a first antenna feed 545 operating a first antenna 540 and a second antenna feed 547 operating a second antenna 543 when a trench 580 in the circuit board 555 establishes a high impedance boundary between the antenna feeds 545 and 547.

As shown in this example embodiment, antennas 540 and 543, as well as trench 580, are disposed between hinge locations 530 and 532 on a PCB circuit board 555. Trench 580 may be material removed from the circuit board 555 between antenna feeds 545 and 547. Trench 580 may be of any geometric shape in various embodiments of the disclosures herein. In some embodiments, trench 580 will extend into circuit board 555 in a dimension extending from the edge of circuit board 555 into the circuit board 555 along and beyond the dimension of the mounted antenna feed 545 and the mounted antenna feed 547. Such an extension of trench 580 may improve isolation according to embodiments herein by providing physical separation along conductive layers of circuit board 555 via the high impedance isolation barrier. The extension of trench 580 into circuit board 555 will extend along and beyond antenna feeds 545 and 547 disposed on the opposite sides of the isolation trench 580 to redirect surface currents 563 away from the opposing antenna feed.

Trench 580 material may be removed or omitted during the formation of circuit board 555 between locations of antenna feeds 545 and 547. In an embodiment, at least the one or more conductive layers of circuit board 555 must be omitted or removed to form trench 580. In other embodiments, an open space forms trench 580. In some embodiments, this open space of trench 580 may be used to house or mount other components 581 of an information handling system where the component 581 installed in the space of trench 580 maintains the high impedance boundary between antenna feeds 545 and 547. The component device 581 inserted in the space of trench 580 must be isolated by at least RF transparent material 582 such as plastics of types known in the art and used with information handling system components. However, electrical connections may be made to the information handling system components through one or more leads 583*a* and 583*b*. In an example embodiment, a cooling fan may be mounted in the space of the isolation trench 580 where the cooling fan has an RF transparent material 582 used to mount to one or more perimeter locations of the trench 580. In other example embodiments, components such as speakers, hard drives, connectors, and other components may be placed.

Trench 580 may also have a perimeter dimension of ¼ the wavelength of the lowest expected frequency of antenna feeds 545 and 547 in some embodiments. The perimeter may also have a conductive edge which is the edge of the circuit board conductive layer which may provide resonance of the radio frequency signals to provide for the effect of redirecting the surface currents 561 and 563 as well as redirecting the hot spot direction of the far field radiation patterns 570 and 573. In one example embodiment for the example frequency of 700 MHz (428 mm wavelength), a perimeter of trench 580 may be 107 mm between antenna feeds 545 and 547 and extending inward from the edge of circuit 555. Depending on operating frequencies shared between antennas 540 and 543, the perimeter dimensions may change in various embodiments. Further, other ratios to the wavelength may provide varying levels of resonance in forming the high impedance boundary isolation trench and prove to reduce noise of proximately located antenna systems such as 540 and 543 in various embodiments. It is contemplated that perimeter dimensions may include other portions of one wavelength and still have mitigating effect. ¼ wavelength is but one example embodiment of a perimeter dimensions.

Further, either or both antennas 540 and 543 disposed on circuit board 555 to operate with antenna feeds 545 and 547 respectively may be mounted to extend into the gap of isolation trench 580. This extension into the gap of 580 may permit the antennas 540 and 543 to be mounted even closer to one another than the antenna feeds 545 and 547 but the noise mitigation benefits of the isolation gap of trench 580 may still be maintained. Thus, with the isolation trench 580, antennas 540 and 543 may be mounted less than 1/10 of the wavelength of lowest operating frequency allowing for a more compact antenna mounting within thin mobile information handling systems. In another example embodiment, for the example frequency of 700 MHz, a distance 550 between antennas 540 and 543 may be less than 20 mm with antennas 540 and 543 extending across the gap of trench 580. It is understood that the present embodiments are not limited to a frequency of 700 MHz and that any expected operating frequency of antennas 540 and 543 may be used in determining trench 580 dimension and separation of the antennas and antenna feeds 545 and 547.

Isolation trench 580 may mitigate potential sources of interference or radio signal quality degradation despite the proximity of antennas 540 and 543 disposed on the circuit board 555. For example, the far field radiation patterns 570 and 573 hotspots may then be directed away from the respective opposite antenna and antenna feed on the other side of isolation trench 580. In other words, far field radiation pattern 570 of antenna 540 from antenna feed 545 may have a hotspot directed away from the proximate antenna 543 and its antenna feed 547 by the resonance along the perimeter of isolation trench 580. This redirection of the far field radiation patterns 570 and 573 may further mitigate potential interference when both antennas 540 and 543 are operating in similar frequency bands.

Additionally, surface currents 561 and 563 emanating from antenna feeds 545 and 547 on circuit board 555 may be directed away from the opposite antenna feed from which they are generated. With the surface currents 561 and 563 directed away from an opposite but proximate antenna feed across the isolation trench 580, undesirable coupling between antenna feeds 545 and 547 may be avoided or mitigated. This may also lessen or eliminate interference due to the coupling between the antenna feeds without requiring more than two wavelengths of distance between the antenna feeds 545 and 547.

The example of FIG. 5 describes two LTE antennas 540 and 545 which, in some example embodiments, may operate within a similar or the same frequency range. For example, antennas 540 and 545 may operate as a 2×2 MIMO system to provide additional data bandwidth in some embodiments. It is understood however, that two WLAN antennas may also be similarly mounted across trench 580 to permit close proximity of antenna mounting by lessen potential interference effects of surface currents and directivity of far field radiation hot spots in other embodiments. Further, it is understood, that one WWAN antenna and one WLAN antenna may also be similarly mounted across trench 580 which may operate in the same or similar frequency band and provide for close proximity of antenna mounting while lessening potential interference effects of surface currents and directivity of far field radiation hot spots in yet other embodiments.

Antennas of any wireless protocol may be used and the embodiments herein may be applied to antennas operating at similar frequency bands to provide a high impedance boundary within circuit board 555. The system and mechanism of the embodiment of FIG. 5 may be applied to a plurality of antennas and antenna feeds utilizing a variety of wireless protocols which may operate in similar frequency bands by mounting antennas on opposite sides of an isolation trench and such embodiments are similarly contemplated herein. Further, any frequency of operation is contemplated for antennas and antenna feeds mounted on opposite sides of an isolation trench within a circuit board such as a PCB or similar board.

Figure 6:
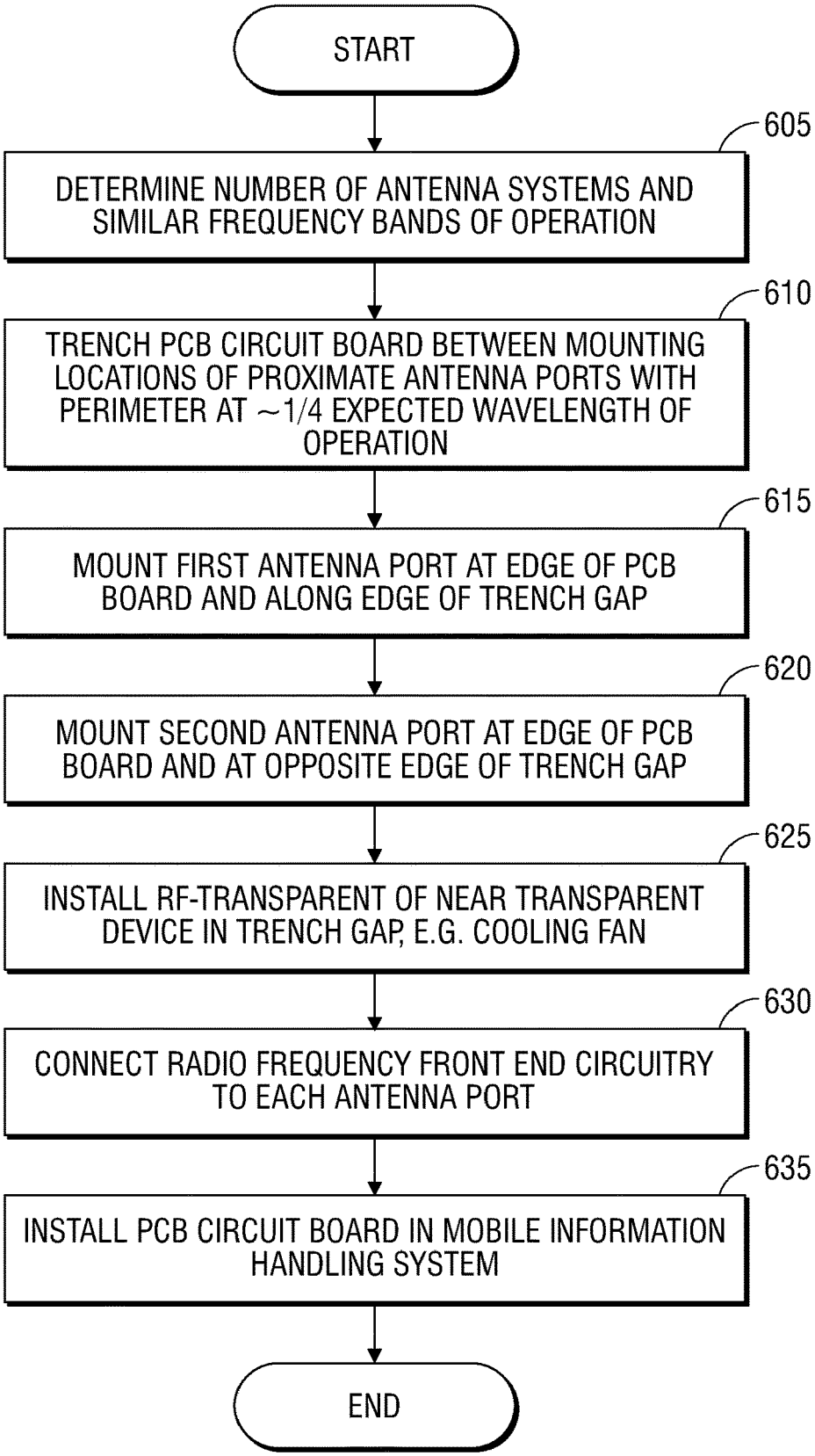
FIG. 6 is a flow chart of providing proximate antenna systems on a circuit board with at least one high impedance boundary for a mobile information handling system according to an embodiment of the present disclosure.

FIG. 6 shows a method for determining placement options for plural antenna systems along a circuit board of an information handling system according to an embodiment of the present disclosure. At 605, a number antenna feeds coupled to, or partially coupled to, a plurality of antennas is determined for an information handling system. Location of features along an edge of the information handling system, such as a convertible information handling system with limited area for mounting antennas may be determined according to an embodiment of the present disclosure. For example, two or more antenna systems may be needed for operation within similar or the same communication frequency bandwidth in an embodiment. In some embodiments, for example, four antennas of similar frequency bands may be needed. Locations available for mounting those antenna systems as well as other antenna systems operating at different frequencies may be challenging due to limited area and size of the information handling system. In one example embodiment, it may be desired to mount the two or more antennas along a back edge of a base housing for an information handling system with a hinged first display housing and a second base housing such as with a laptop, a convertible laptop system, or a convertible dual display screen housing mobile information handling system capable of various configurations. The back edge may include hinge points in some embodiments, thus squeezing antennas between the hinges may be desirable in some embodiments.

Proceeding to 610, to squeeze a plurality of antennas operating at similar communication bands along an edge of a circuit board for an information handling system, an isolation trench in the circuit board may be required. An isolation trench may be formed in the circuit board between disposition locations of the antenna feeds of two antenna systems to mitigate potential interference sources between the proximate antenna feeds and antennas.

In an example embodiment, the trench may extend in from an edge of the circuit board with a trench perimeter of ¼ of the expected wavelength of the lowest operating frequency. The isolation trench may be a formed circuit board with at least the conductive layers of the circuit board missing in the geometry of the trench some embodiments. In other aspects, the trench may be formed in the circuit board such that an gap in the circuit board is formed as the isolation trench and the edge of the circuit board follows the geometry of the perimeter of the isolation trench. The isolation trench in embodiments will extend from the edge of the circuit board inward generally toward the center line of the circuit board parallel to the edge of the circuit board. In an example embodiment, the isolation trench may extend inward from a linear edge of the circuit board which may form the back edge or a side edge of an information handing system. The perimeter of the circuit board may include a perimeter of the one or more conductive layers of the circuit board such that the perimeter edge may resonate the operating frequency or frequencies to provide for the redirection of the far-field radiation pattern as well as assist with redirection of the surface currents to isolate the antenna ports from coupling. Further, the geometry of the isolation trench may vary in several embodiments. In some embodiments, the isolation trench may extend inward from an edge of the circuit board past the locations of antenna feeds mounted on either side of the trench such that a high impedance boundary will be formed between all portions of the antenna ports and antennas.

At 615, the first antenna port or antenna feed may be disposed on the circuit board along the edge of the circuit board and along or near a first side edge of the isolation trench at the trench opening in the circuit board edge. As described, the isolation trench may extend past the antenna port or antenna feed structure to provide isolation gap distance to cause surface currents in the one or more conductive layers to have further to travel to an antenna feed mounted across the isolation trench.

At 620, the second antenna port or antenna feed may be mounted on the circuit board along the edge of the circuit board and along or near a second side edge of the isolation trench at the trench opening in the circuit board edge. In this way the second antenna port or feed is along a same edge of the circuit board but mounted opposite the isolation gap formed by the isolation trench As described previously, the isolation trench may extend past the second antenna port or antenna feed structure as well to provide an isolation gap distance to cause surface currents in the one or more conductive layers to have further to travel to the first antenna feed mounted across the isolation trench. Namely, the perimeter distance of the isolation trench increases the distance for surface currents between the two antenna feeds, however the first and second antenna feeds may still me mounted proximate to one another along an outer edge of the circuit board, albeit separated by the isolation trench. In other aspects, the perimeter edge of the isolation trench may be conductive, such as from a conductive layer of the circuit board, such that its resonance assists with directionality of far field radiation patterns. With this design, the antenna ports and the corresponding wireless antennas may be mounted in closer linear proximity to one another along an edge or side of an information handling system than without the isolation trench architecture while still maintaining reduced or mitigated interference.

In an example embodiment, at 625, an internal component of the information handling system comprised of a portion of RF-transparent material, or which is substantially isolated from the conductive perimeter edge of the isolation trench by an edge of RF-transparent material may be installed in the gap formed by the isolation trench in the circuit board. RF-transparent material may be a variety of types of plastic for example. It is understood, that some electrical or communication connectivity to the circuit board in which the isolation trench is formed is contemplated in some embodiments. However, if a majority of the installed component in the gap of the isolation trench is isolated from the circuit board conductive layers by RF transparent material, the isolation trench may still operate to mitigate sources of interference such as described in embodiments herein. For example, several conductive leads for power or communication may be operatively coupled between the component installed in the gap of the isolation trench and the circuit board in some embodiments. In an aspect, the conductive couplings, if any, with a component may be located along a perimeter location of the isolation trench away from the first or second antenna feeds mounted on either side of isolation trench to reduce a chance of resonance effects.

Proceeding to 630, radio frequency front end circuitry may be operatively couple to the antenna feeds disposed on the circuit board for enabling wireless communications via the antennas mounted opposite one another across the isolation gap of the isolation trench. In an embodiment, one radiofrequency front end may be connected to a plurality of antenna feeds. In other embodiments, each antenna feed may be operatively coupled to separate radiofrequency front end circuitry. The radiofrequency front end circuitry may be similar to that described as part of a wireless adapter and may operate as described herein and according to any wireless protocol as understood by those of skill. For example, MIMO operation may operate a plurality of antenna feeds to provide for enhanced bandwidth. Any number of antennas may be used for MIMO operation in some embodiments including 2×2 or 4×4 antenna arrays in some example embodiments. Two or more of these plural antennas operating in an information handling system may be separated by one or more isolation trenches according to various embodiments herein.

At 635, the circuit board may be installed in an information handling system such that the plural antenna systems may be arranged as desired along one or more edges of the information handling system. The antenna systems may be thus positioned in closer proximity across the isolation trench with less induced interference relative to position of antennas without such a isolation trench or plural trenches. At this point the method may end. It is understood that the methods and concepts described in the algorithm above for FIG. 6 may be performed in any sequence or steps may be performed simultaneously in some embodiments. It is also understood that in some varied embodiments certain steps may not be performed at all or additional steps not recited in the above figures may be performed. It is also contemplated that variations on the methods described herein may also be combined with portions of any other embodiments in the present disclosure to form a variety of additional embodiments.

Figure 7:
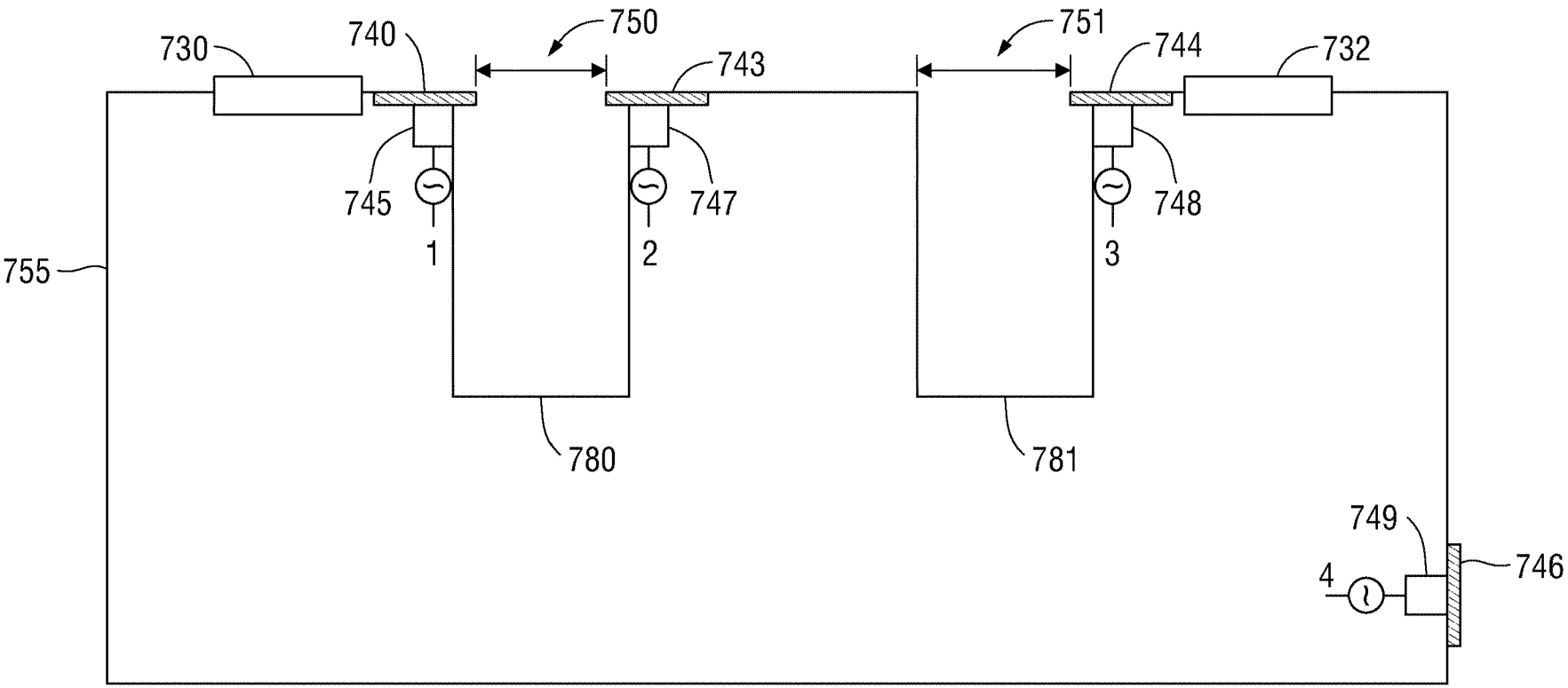
FIG. 7 is a graphical diagram of proximate antenna systems on a circuit board with a high impedance boundaries for a mobile information handling system according to yet another embodiment of the present disclosure.

FIG. 7 shows graphical diagram of antenna systems 740, 743, 744, and 746 mounted on a circuit board 755 for a mobile information handling system according to an embodiment of the present disclosure. FIG. 7 illustrates a variety of potential arrangements of antenna systems 740, 743, 744, and 746 wherein some may be proximately located near one another. For example, as with other embodiments, antennas 740 and 743 may be located across a first isolation trench 780 with a proximity of 750 that is less than one or two wavelengths. In another aspect, a third antenna 744 may be located across a second isolation trench 781 less than one or two wavelengths from the next proximate antenna 743. In both cases, the isolation trenches 780 and 781 allow for mounting of the antenna systems 740, 743, and 744 and their respective antenna ports/feeds 745, 747, and 748 each less than $1/5^{th}$ of a wavelength or even less than $1/10^{th}$ a wavelength apart along a circuit board edge with mitigated noise impacts. In other aspects, a fourth antenna 746 may be situated more than two wavelengths away from the other antennas 740, 743, and 744 such that four antenna systems may be packed into more compact area on circuit board 755 of an information handling system. In an example embodiment, antenna systems 740, 743, and 744 as well as respective antenna feeds 745, 747, and 748 may be disposed between hinges 730 and 732 along one edge of circuit board 755 with the use of isolation trenches 780 and 781 of the present disclosure. In another aspect, a third isolation trench (not shown) may be used between antenna 746 and antenna port 749 to permit closer location to a next closest antenna of among the antennas, for example antenna 744 and feed 748. Any number of isolation trenches in circuit board 755 may be used according to some embodiments.

FIG. 7 may represent activity for a first antenna feed 745 operating first antenna 740, a second antenna feed 747 operating second antenna 743, a third antenna feed 748 operating third antenna 744, and a fourth antenna feed 749 operating fourth antenna 746 to allow four antenna systems to operate simultaneously in a compact area of an information handling system circuit board 755 with reduced or mitigated interference. In an example embodiment, a 4×4 MIMO antenna arrangement, such as for WWAN or WLAN, is available and the compactness of antenna locations is an advantage in design of a mobile information handling system with limited available circuit board area. The use of trenches 780 and 781 extending from an edge of the circuit board 755 establishes two high impedance boundaries that may be placed between the antenna feeds, such as 745 and 747 as well as between 747 and 748 in an example embodiment.

The antennas 740 and 743 are disposed at a proximate distance 750 which may be less than one or two wavelengths for the lowest operating frequency of antenna feeds 745 and 747 in an example embodiment. As described herein and in other embodiments, the proximate distance 750 depicted may be less than ⅕ of a wavelength or even less than 1/10 of a wavelength of the lowest frequency operating on antenna feeds 745 and 747. In one example embodiment for the example frequency of 700 MHz, a distance 750 between antennas 740 and 743 may be less than 40 mm. The proximate distance 750 is across the isolation trench 780 between the antenna feeds 745 and 747. Further, antennas 740 and 743 may extend into the gap of isolation trench 780 to allow the antennas 740 and 743 to be closer than the sides of isolation trench 780 along which antenna feeds 745 and 747 may be disposed in some embodiments. Antenna feeds 745 and 747 may be disposed in some embodiments along opposite edges of isolation trench 780 or may be disposed elsewhere along the circuit board 755 but across the isolation trench 780 from one another.

Similarly, the antennas 743 and 744 are disposed at a proximate distance which may also be less than one or two wavelengths for the lowest operating frequency of antenna feeds 747 and 748 in an example embodiment. Also in other embodiments, the proximate distance between antennas 743 and 744 may be less than ⅕ of a wavelength or even less than 1/10 of a wavelength of the lowest frequency operating on antenna feeds 747 and 748. In one example embodiment, for the example frequency of 700 MHz, a distance between antennas 743 and 744 may be less than 40 mm. In another example embodiment a different example frequency, such as 2.4 GHz, may be the common frequency band between antenna feeds 747 and 748. In other words, the antenna 743 may operate at two frequency bands one or which is shared with antenna feed 745 and the other which is shared with 748 in an example embodiment. In such a case, the new common frequency may impact the perimeter length of isolation trench 781 and the distance between antennas 743 and 744.

In either case, the proximate distance between the antenna feeds 747 and 748, as well as between antennas 743 and 744, may be shortened with less adverse noise effects because it is across the second isolation trench 781. Further, either or both antennas 743 and 744 may extend into the gap of isolation trench 781 to allow the antennas 743 and 744 to be closer than the sides of isolation trench 781 in some embodiments. Antenna feeds 747 and 748 may be disposed in some embodiments along opposite edges of isolation trench 781 or may be disposed elsewhere along the circuit board 755 but across the isolation trench 781. Thus, the issue of the proximity causing one or more sources of noise may be improved with the implementation of the isolation trenches 780 and 781 in the circuit board 755.

As shown in this example embodiment, isolation trenches 780 and 781 extending from an edge of the circuit board 755 may have a trench perimeter of any geometry. In FIG. 7, the geometry of isolation trenches 780 and 781 extending into the circuit board 755 are rectangular as compared to arcuate trenches depicted in embodiment of other figures. Trenches 780 and 781 may be material removed from the circuit board 755 between antenna feeds 745 and 747 as well as antenna feeds 747 and 748 to provide additional compact location of several antennas on circuit board 755 in some embodiments. Although only two isolation trenches 780 and 781 are shown in FIG. 7, it is contemplated that more than two isolation trenches may be used and they may be of any geometric shape or differing geometric shapes to accommodate space needs on circuit board 755.

In some embodiments, trenches 780 and 781 will extend into circuit board 755 in a dimension extending from the edge of circuit board 755 along and beyond antenna feeds such as 745 and 747 or 747 and 748 into the circuit board 755. The extension of isolation trench 780 and 781 into circuit board 755 will extend along and beyond the dimension of isolated antenna feeds 745 and 747 or 747 and 748 on the opposite sides of the isolation trenches 780 and 781 to redirect surface currents away from oppositely disposed antenna feeds along the trenches 780 and 781.

To form trenches 780 and 781, material may be removed from circuit board 755 or omitted during the formation of circuit board 755 between disposition locations of antenna feeds 745 and 747 or between 747 and 748 in example embodiments. In an embodiment, at least the one or more conductive layers of circuit board 755 must be omitted or removed to form trench 780 or trench 781. In other embodiments, an open space or gap is left to form trenches 780 and 781. In some embodiments, these open spaces or gaps of trenches 780 and 781 may be used to house or mount other components of an information handling system. The other information handling system components may be installed in the space of trenches 780 or 781 as long as it generally maintains the high impedance boundary between antenna feeds 745 and 747 or 747 and 748 intended by the isolation trenches 780 and 781. The component device inserted in the space of either or both trenches 780 or 781 must be isolated by at least RF transparent material such as plastics of types known in the art and used with information handling system components. However, electrical connections may be made to the information handling system components through one or more leads. In an example embodiment, a cooling fan may be mounted in the spaces of the isolation trench 780 or trench 781 where the cooling fan has RF transparent material that is used to mount to one or more perimeter locations of the trench 780 or 781. In other example embodiments, components such as speakers, hard drive, flash drive, connectors or the like may occupy the trench space. The gaps or spaces of isolation trenches 780 and 781 may accommodate different information handling system components or no components at all in various embodiments.

The isolation trenches 780 and 781 may also have a perimeter dimension of ¼ the wavelength of the lowest expected frequency of antenna feeds mounted on either side and isolated by those trenches; for example 745 and 747 or 747 and 748 respectively in some embodiments. Other portions of wavelengths may also be used with varying effectiveness at mitigating noise sources as well in some embodiments. The perimeter of isolation trenches 780 and 781 may also have an edge that is an RF conductive material such as the circuit board conductive layer that may provide resonance of the radio frequency signals to provide for the effect of redirecting the surface currents as well as redirecting the hot spot directions of the far field radiation patterns for the antennas such as for 740, 743, and 744. The conductive material of the perimeter of the isolation trenches 780 or 781 may operate as a decoupling resonator for the operating frequencies to mitigate the surface currents for example. In one example embodiment for the example frequency of 700 MHz (428 mm wavelength), a perimeter of trenches 780 and 781 may be 107 mm between antenna feeds such as 745 and 747 or 747 and 748 mounted on either side of those trenches 780 and 781. It is understood that the present embodiments are not limited to a frequency of 700 MHz and that any expected operating frequency of antennas 740, 743, and 744 may be used in determining trench 780 and 781 dimensions and separation of the antennas and antenna feeds 745, 747, and 748. Moreover, the same frequencies may not be used in determining the isolation trench perimeter dimensions of 780 and 781 in some circumstances such as when antenna feed 747 may operate at several frequency bandwidth ranges that may differ from those options of antenna feeds 745 and 748.

According to embodiments herein, the isolation trenches 780 and 781 may mitigate potential sources of interference or radio signal quality degradation despite the proximity of several antennas, such as 740, 743, and 744 as well as antenna 746 which may be more remotely disposed on the circuit board 755. Note that the distances between antennas, such as between antennas 740 and 743, 743 and 744, as well as 744 and 746, may not appear to scale in FIG. 7. As described with respect to example embodiments herein, the far field radiation patterns hotspots of antenna systems 740, 743, 744 or other antenna systems with isolation trenches may then directed away from proximate antennas and antenna feeds on the opposite side of an isolation trench such as 780 or 781. Hotspot radiation patterns may be directed away from nearby the proximate antennas along opposite sides of isolation trenches by the resonance along the perimeter of isolation trench 780 or 781 in accordance with descriptions herein. This redirection of the far field radiation patterns may further mitigate potential interference when antennas are operating in similar frequency bands. Additionally, surface currents emanating from antenna feeds on circuit board 755 may be directed away from the opposite antenna feeds across isolation trenches from which they are generated. With the surface currents directed away from an opposite but proximate antenna feed across an isolation trench 780 or 781, undesirable coupling between antenna feeds may be avoided or mitigated. This may also lessen or eliminate interference due to the coupling between the antenna feeds without requiring more than two wavelengths of distance between the proximate antenna feeds.

In the example of FIG. 7, LTE antennas, WiFi antennas or other antennas which, in some example embodiments, may operate within a similar or the same frequency range may be located with one or more isolation trenches according to embodiments herein. For example, antennas 740, 743, 744, and 745 may operate as one or more 2×2 MIMO systems or a 4×4 MIMO to provide additional data bandwidth in some embodiments. To achieve compactly located antenna locations, the above isolation trenches such as 780 and 781 or additional trenches may be used, however for a four antenna information handling system, some antennas may also operate at different frequency bands and remain in proximity in some other embodiments with less need of isolation. In yet other embodiments, one or more antenna systems of a system of three or more antennas may be located more than one or two wavelengths away from other antennas while the proximate antennas may utilize the isolation trench of the present embodiments. For example, antenna 746 and antenna feed 749 may operate at different frequency bands from antenna 744 and antenna feed 748 or may be located more than two wavelengths away in various embodiments. In such a case, four antennas may be mounted to circuit board 755 for an information handling system while providing flexibility about antenna locations while still benefiting from mitigated interference and increased functionality of several antenna systems. For example, a 4×4 MIMO antenna system may be established providing substantial wireless data bandwidth in some embodiments.

The system and mechanism of the embodiment of FIG. 7 may be applied to a plurality of antennas and antenna feeds utilizing a variety of wireless protocols which may operate in similar frequency bands by mounting antennas on opposite sides of an isolation trench and such embodiments are similarly contemplated herein. Further, any frequency of operation is contemplated for antennas and antenna feeds mounted on opposite sides of an isolation trench within a circuit board such as a PCB or similar board.

Figure 8A:
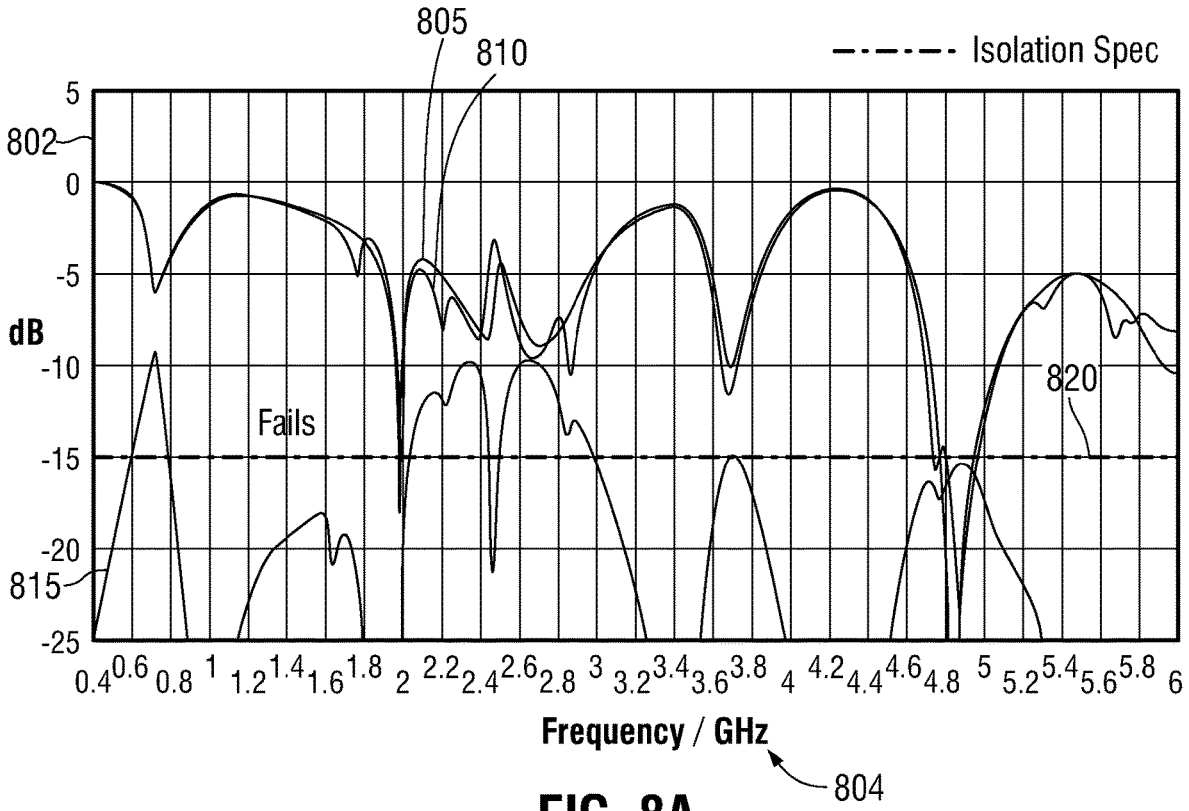
FIG. 8A is a graphical diagram of antenna port isolation without a high impedance boundary according to an embodiment of the present disclosure.
Figure 8B:
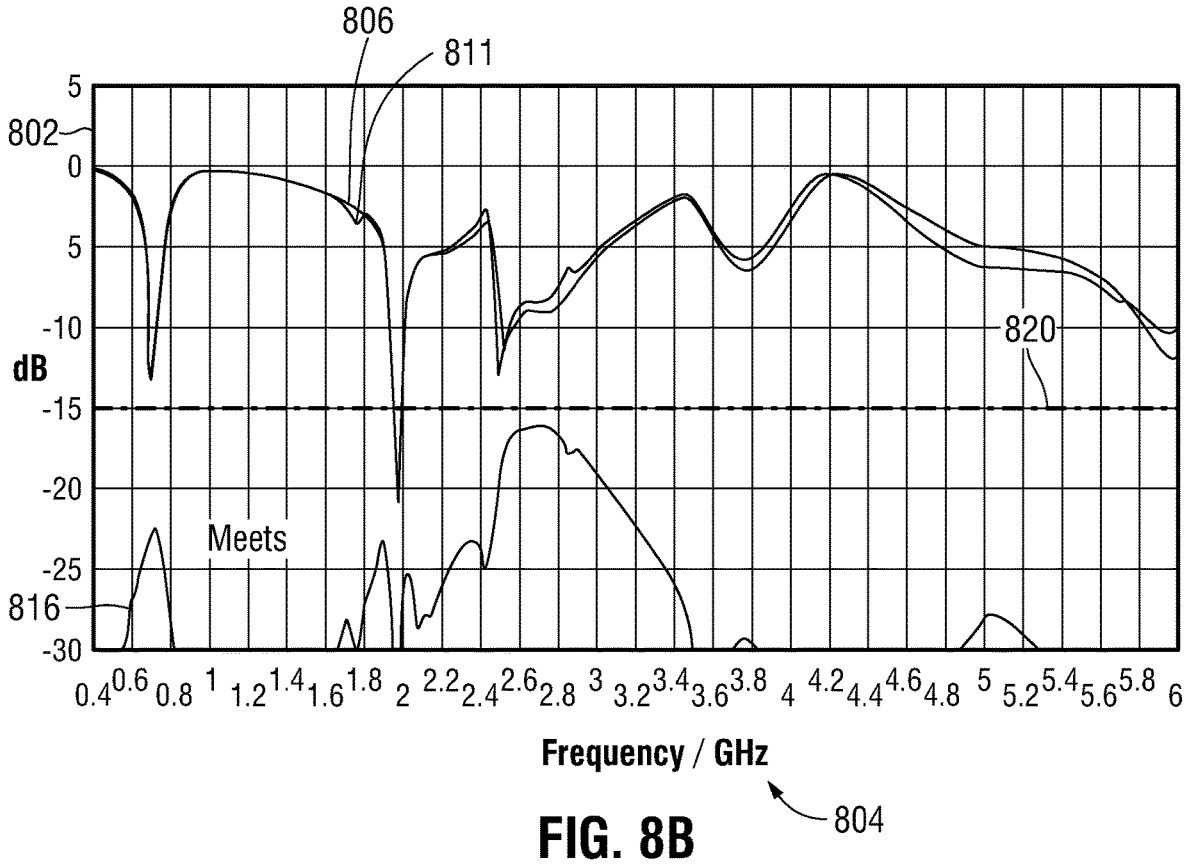
FIG. 8B is a graphical diagram of antenna port isolation with a high impedance boundary according to an embodiment of the present disclosure.

FIG. 8A and FIG. 8B show a graphical depiction of the effectiveness of antenna port isolation in an example embodiment of the present disclosure. In FIG. 8A a graphical diagram depicts operation of a pair of antenna feeds and antennas without use of an isolation trench in an embodiment showing a baseline of power coupling at the antenna ports or feeds of a first and second antenna system. FIG. 8A depicts energy loss levels in dB along the y-axis 802 relative to frequency along the x-axis 804. An example lowest operating frequency of 700 MHz is noted along the x-axis 804.

FIG. 8B is a graphical diagram depicting operation of a pair of antenna feeds and antennas but with implementation of an isolation trench in an embodiment showing improved isolation and reduction in power loss for the antenna ports or feeds of the first and second antenna systems separated by an isolation trench. Similarly FIG. 8B depicts energy loss levels in dB along the y-axis 802 relative to frequency along the x-axis 804. An example lowest operating frequency of approximately 700 MHz is noted along the x-axis 804.

Returning to FIG. 8A, trace 805 and trace 810 represent reflected power at each of the two antenna ports in the example embodiment. For example, 805 represents a measurement looking into a first antenna port from that same antenna port. Further, 810 represents a measurement of energy loss looking into a second antenna port from the second antenna port to measure reflective power loss at those ports. Trace 815 represents coupled power from the first antenna port 805 into the second antenna port 810 and vice-versa. A larger negative energy loss level in dB represents less energy leaked at the ports or antenna feeds of a first and second antenna system or represents less coupled loss between the first and second antenna feeds. In the example embodiment at 700 MHz, reflective power of both the first antenna port 805 and second antenna port 810 nearly match at approximately—6 dB. Coupled power 815 between the first and second antenna is −10 dB. As seen in FIG. 8B, with the implementation of an isolation trench between the first and second antenna ports, reflective power loss for the first and second antenna ports similarly match along traces 806 and 811 in FIG. 8B. At approximately 700 MHz, the energy loss level of traces 806 and 811 improves to closer to −14 dB. Coupled power 816 between the first and second antenna is −23 dB. This is due to the anti-resonance caused due to the perimeter of the isolation trench reducing coupled power at the antenna ports mounted on either side of the trench.

Returning to FIG. 8A, trace 815 represents an amount of coupled power between the first antenna port and the second antenna port in an example embodiment without an isolation trench. In FIG. 8B, trace 816 represents an amount of coupled power between the first antenna port and the second antenna port in an example embodiment where an isolation trench has been used. Measurement of energy loss may be made from either the first port looking into the second port or at the second port looking into the first antenna port in both examples. At 820 in both FIG. 8A and FIG. 8B, an isolation specification level for a device is depicted of at least −15 dB between the first and second antenna ports.

In the example embodiment of FIG. 8A at approximately 800 MHz, decoupling between the first antenna port and the second antenna port is approximately −10 dB meaning that an estimated 80% of energy at these ports is decoupled or transmitted and an estimated 20% of power is lost due to coupling. Further, −10 dB at the spacing used for the first and second antenna ports without the isolation trench fails to meet the isolation specification level 820 of −15 dB. When an isolation trench is utilized however at the same spacing between the first antenna port and the second antenna port as in FIG. 8B, the power coupled between the first and second antenna ports is reduced to −23 dB at approximately 800 MHz. The −23 dB level for the same spacing but across an isolation trench of the present embodiments represents an estimated decoupled power level of 98% with only 2% power coupled between the first and second antenna ports in an example embodiment. The lower the coupled power level along y-axis 802 in FIGS. 8A and 8B, the less energy is leaked at or between the first or second antenna feeds. In the latter case of FIG. 8B, the negative coupled power level of −23 dB at approximately 800 MHz meets or exceeds the isolation specification level 820 of −15 dB. Note also that the isolation specification level 820 of −15 dB is also met by trace 816 at all other frequencies shown in FIG. 8B.

Figure 9A:
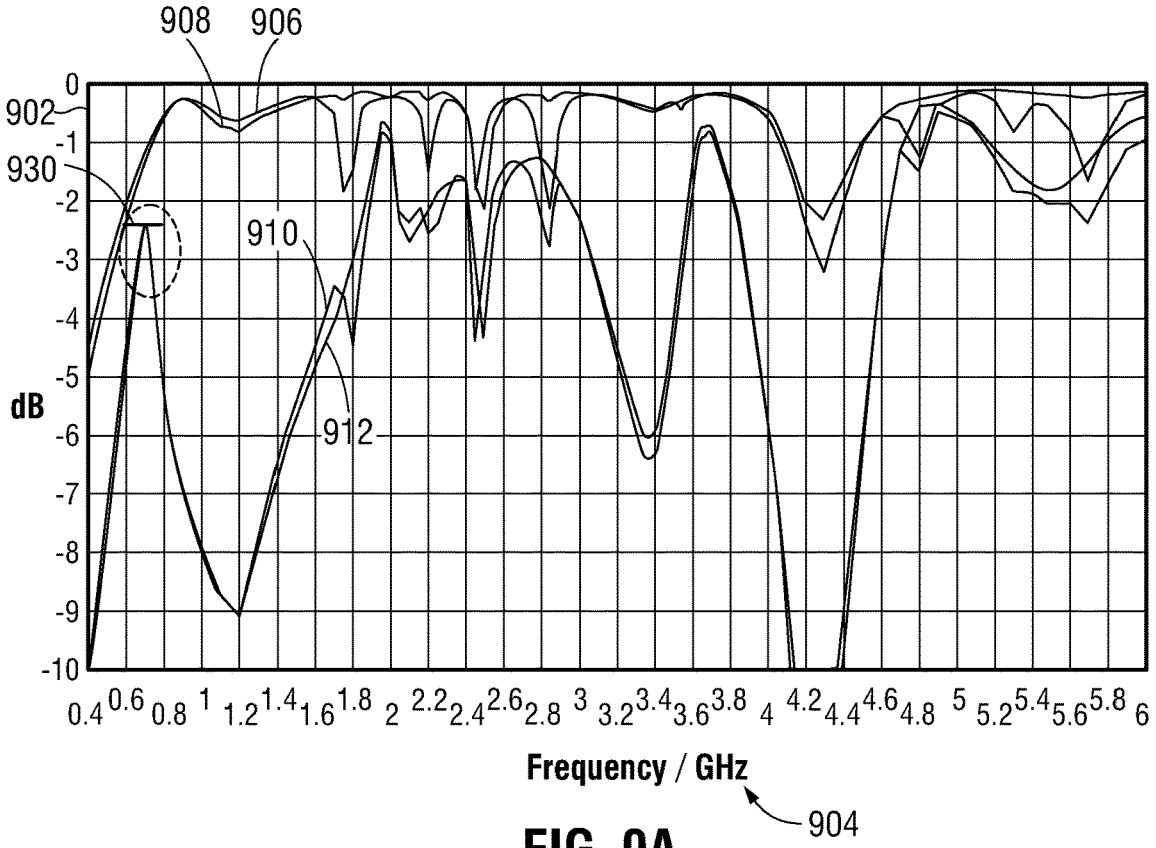
FIG. 9A is a graphical diagram of antenna efficiency without a high impedance boundary according to an embodiment of the present disclosure.
Figure 9B:
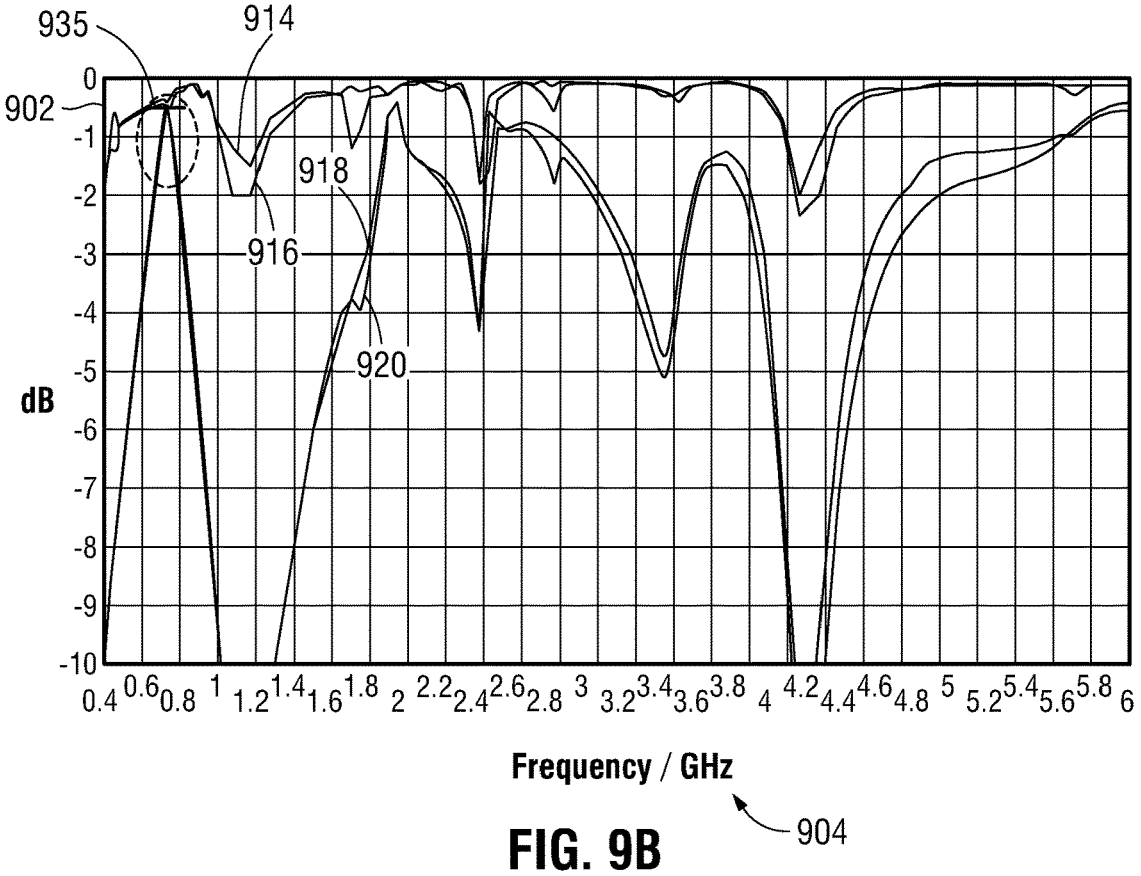
FIG. 9B is a graphical diagram of antenna efficiency isolation with a high impedance boundary according to an embodiment of the present disclosure.

FIG. 9A and FIG. 9B show another graphical depiction of the effectiveness of antenna port isolation in an example embodiment of the present disclosure. In FIG. 9A a graphical diagram depicts operation of a pair of antenna feeds and antennas without use of an isolation trench in an embodiment showing a baseline of antenna radiation efficiency 930 from the antenna ports or feeds via a first and second antenna system. FIG. 9A depicts radiated energy loss levels in dB along the y-axis 902 relative to frequency along the x-axis 904. An example lowest operating frequency of 700 MHz along the x-axis 904 shows a peak radiated energy level in circle 930. A smaller negative value in dB (close to zero) radiated energy loss level represents less energy lost due to coupling and more energy radiated from the ports or antenna feeds by the first and second antenna system.

FIG. 9B is another graphical diagram depicting operation of a pair of antenna feeds and antennas but with implementation of an isolation trench in an embodiment showing improved radiated antenna efficiency from the antenna ports or feeds via a first and second antenna system separated by an isolation trench. Similarly FIG. 9B radiated energy loss levels in dB along the y-axis 902 relative to frequency along the x-axis 904. An example lowest operating frequency of approximately 700 MHz along the x-axis 904 shows a peak radiated energy level in circle 935 and illustrates the antenna efficiency improvement relative to the system in FIG. 9A with similar antenna spacing but without an isolation trench.

The smaller negative radiated energy loss level in dB closer to 0 dB shows the improved antenna radiated power levels and represents less energy leaked at the ports or antenna feeds of the first and second antenna systems.

Returning to FIG. 9A, trace 906 and trace 908 represent antenna radiation efficiency power levels at each of the two antennas when only one antenna systems operates at a time in the example embodiment. In other words, trace 906 represents only operation of a first antenna system without any operation of a proximate second antenna system simultaneously. Further, trace 908 represents a measurement of transmitted energy operation of a second antenna system without any operation of a proximate first antenna system simultaneously. In the example embodiment at 700 MHz, both the first antenna port and second antenna port nearly match at approximately the same antenna efficiency level between 0 dB and −1 dB. For FIG. 9B, trace 914 and trace 916 represent antenna radiation efficiency at each of the two antennas which are separated by an isolation trench according to embodiments of the present disclosure but when only one antenna systems operates at a time in the example embodiment. For example, 914 represents only operation of a first antenna system near an isolation trench without any operation of a proximate second antenna system across the isolation trench simultaneously. Further, 916 represents a measurement of antenna radiation efficiency during operation of a second antenna system without any operation of a proximate first antenna system across an isolation trench simultaneously. In the example embodiment at 700 MHz, both the first antenna port and second antenna port again nearly match at approximately the same antenna efficiency level between 0 dB and −1 dB.

Returning to FIG. 9A, trace 910 and trace 912 represent antenna radiated power or radiation efficiency at each of the two antennas when both the first and second antenna operate simultaneously in the example embodiment without an isolation trench. The traces 910 and 912 reflect the radiated power loss due to coupling between the first and second antenna systems during simultaneous as compared to the operation in traces 906 and 908 when only one antenna operates at a time. For example, 910 represents a measurement of radiated energy by the first antenna when both the first and second antenna are operating proximately without an isolation trench. Further, 912 represents a measurement of radiated energy delivered by the second antenna during simultaneous operation with the first antenna. In the example embodiment of FIG. 9A without use of an isolation trench, the radiated antenna efficiency is between—2 dB and −3 dB of transmitted power loss for both the first antenna and second antenna at the same time is shown in traces 910 and 912 at approximately 700 MHz. This reflects less radiated power compared with traces 906 and 908 when the first and second antennas operate alone.

As seen in FIG. 9B, with the implementation of an isolation trench between the first and second antenna ports, antenna efficiency is improved. The antenna radiation efficiency delivered by the first antenna is shown by trace 914, and the radiation efficiency delivered by the second antenna is shown by trace 916. In the example embodiment of FIG. 9B where use of an isolation trench according to embodiments of the present disclosure is implemented, the antenna radiation efficiency is between 0 dB and −1 dB of transmitted power loss for both the first antenna and second antenna for which traces 918 and 920 while both are operating. At approximately 800 MHz, this is not too different from the levels representing the first antenna and second antennas operating alone as represented by traces 914 and 916. Again, the resonance of the perimeter of the isolation trench in reducing reflective power at the antenna ports mounted on either side of the isolation trench and in reducing port coupling yields an antenna radiation efficiency improvement in the example embodiment of about 2 dB for both antennas operating simultaneously.

It is understood that the data shown in FIGS. 8A, 8B, 9A, and 9B are merely exemplary for purposes of explanation and represent a set of example embodiments of two antenna systems mounted on a circuit board with and without an isolation trench according to embodiments herein. It is further understood that additional components or placement within an information handling system, different geometries, differing distances, additional isolation trenches, or other factors may alter or change the data represented. Nonetheless, FIGS. 8A, 8B, 9A, and 9B show the improvement effect on the coupling and reflected energy loss of utilization of some of the embodiments herein.

In some embodiments, dedicated hardware implementations such as application specific integrated circuits, programmable logic arrays and other hardware devices can be constructed to implement one or more of the methods described herein or portions of one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device). The device or module can include software, including firmware embedded at a device, such as an Intel® Core™ or ARM® RISC brand processors, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. An information handling system comprising:

a processor, a memory, and a wireless adapter;

a first antenna feed and second antenna feed operatively connected via a circuit board to the wireless adapter for communicating on a plurality of wireless links;

the circuit board on which the first antenna feed and second antenna feed are disposed and operatively connected to a first antenna and a second antenna respectively along a first outer edge of the circuit board;

a trench through one or more metallic layers of the circuit board extending from the first outer edge of the circuit board into the circuit board;

the first antenna feed mounted adjacent to a first side of the trench of the circuit board;

the second antenna feed mounted adjacent to a second side of the trench of the circuit board opposite to the first side;

the first antenna disposed along the first outer edge of the circuit board formed on the circuit board at a first corner of the first outer edge and the first side of the trench;

the second antenna disposed along the first outer edge of the circuit board formed on the circuit board at a second corner of the first outer edge and the second side of the trench; and the first antenna and the second antenna communicatively coupled to the wireless adapter via the circuit board and located less than one wavelength apart across the trench of the circuit board along the first outer edge, wherein the one wavelength is a wavelength of an operating frequency of the first and second antenna feeds.

2. The information handling system of claim 1 wherein the trench through one or more metallic layers has an arch shaped perimeter.

3. The information handling system of claim 1 wherein the trench through one or more metallic layers has a rectangular perimeter.

4. The information handling system of claim 1 wherein the first antenna and the second antenna are disposed between two hinges attaching a display housing to a base housing of the information handling system.

5. The information handling system of claim 1 wherein the first and second antenna feeds are part of a 2×2 multiple-input, multiple-output (MIMO) wireless communication system.

6. The information handling system of claim 1 wherein the first antenna and the second antenna are low frequency WWAN antennas.

7. The information handling system of claim 1, further comprising:

an information handling system component mounted in the trench and isolated from the perimeter edge of the trench by radio frequency transparent material except for a plurality of electrical leads.

8. The information handling system of claim 1 wherein the first antenna and the second antenna are WWAN antennas.

9. An information handling system comprising:

a processor, a memory, and a wireless adapter;

a first feed and second antenna feed operatively connected to the wireless adapter via a circuit board for communicating on a plurality of wireless links;

the circuit board on which the first antenna feed and second antenna feed are disposed and operatively connected to a first antenna and a second antenna respectively formed along a first outer edge of the circuit board;

a trench through the circuit board extending into the circuit board from the first outer edge of the circuit board with a trench perimeter dimension of ¼ or more of a longest wavelength of operation for communication signals on the first and second antenna feeds;

a portion of the first antenna formed on the circuit board along the first outer edge and configured to extend from a corner of the first outer edge of the circuit board and the trench into a gap formed in the first outer edge by the trench;

the first antenna feed mounted adjacent to a first side of the trench of the circuit board;

the second antenna formed on the circuit board along the first outer edge across the gap formed in the first outer edge by the trench; and the second antenna feed mounted adjacent to a second side of the trench of the circuit board opposite to the first side, wherein the first antenna feed and the second antenna feed are communicatively coupled to the wireless adapter via the circuit board.

10. The information handling system of claim 9 wherein the trench through one or more metallic layers has an arch shaped perimeter.

11. The information handling system of claim 9 wherein the first antenna and the second antenna may be located at a distance less than ⅕ of the longest wavelength of operation apart across the trench in the circuit board.

12. The information handling system of claim 9 wherein the first antenna extends from the edge on the first side of the trench into a gap formed by the trench in the circuit board.

13. The information handling system of claim 9 wherein the first and second antenna feeds are part of a 2×2 multiple-input, multiple-output (MIMO) wireless communication system.

14. The information handling system of claim 9, further comprising:

a cooling fan component mounted in the trench and isolated from at least a portion of the perimeter edge of the trench by radio frequency transparent material.

15. An information handling system comprising:

a processor, a memory, and a wireless adapter;

a first antenna feed, a second antenna feed, and a third antenna feed operatively connected to a wireless adapter via a circuit board for communicating on a plurality of wireless links;

the circuit board on which the first antenna feed, the second antenna feed, and the third antenna feed are disposed and operatively coupled to a first antenna, a second antenna and a third antenna respectively formed along a first outer edge of the circuit board and communicatively coupled to the wireless adapter via the circuit board;

a first trench through the circuit board between the first antenna feed and the second antenna feeds, the first trench extending from the first outer edge of the circuit board into the circuit board with a first trench perimeter dimension of ¼ or more of a longest wavelength of operation for communication signals on the first and second antenna feeds;

the first antenna formed on the circuit board along the first outer edge of the circuit board at a first corner of the first outer edge and a first side of the first trench;

the second antenna formed on the circuit board along the first outer edge of the circuit board at a second corner of the first outer edge and a second side of the first trench, where the second corner is located across a gap formed by the first trench from the first corner;

the first antenna feed mounted adjacent to the first side of the first trench of the circuit board; and the second antenna feed mounted adjacent to the second side of the first trench of the circuit board opposite to the first side and the second antenna feed operatively connected to the second antenna.

16. The information handling system of claim 15, further comprising:

a second trench through the circuit board between the second antenna feed and the third antenna feed, the second trench extending from the first outer edge of the circuit board with a trench perimeter dimension of ¼ or more of a longest wavelength of operation for communication signals operating on the second and third antenna feeds; and the third antenna feed mounted adjacent to the second trench of the circuit board opposite to the second antenna feed.

17. The information handling system of claim 15 wherein the third antenna feed is spaced more than a distance of two wavelengths from the first and second antenna feeds.

18. The information handling system of claim 15 wherein the third antenna extends from the edge on the second trench into a gap formed by the second trench in the circuit board.

19. The information handling system of claim 15 wherein the first antenna feed, the second antenna feed, and the third antenna feed are part of a 4×4 multiple-input, multiple-output (MIMO) wireless communication system.

20. The information handling system of claim 15, further comprising:

an information handling system component mounted in the first trench and isolated from at least a portion of the perimeter edge of the trench by radio frequency transparent material.

* * * * *